US006254159B1

(12) United States Patent
Wieczorek et al.

(10) Patent No.: US 6,254,159 B1
(45) Date of Patent: Jul. 3, 2001

(54) OFFROAD SEARCH AND RESCUE VEHICLE

(76) Inventors: Ardell G. Wieczorek, P.O. Box 1190, Merlin, OR (US) 97532; Mark D. Wieczorek, 5038 Saratoga Ave., San Diego, CA (US) 92107

( * ) Notice: Subject to any disclaimer, the term of this patent is extended or adjusted under 35 U.S.C. 154(b) by 0 days.

(21) Appl. No.: 09/373,886

(22) Filed: Aug. 12, 1999

(51) Int. Cl.[7] ..... A61G 3/00
(52) U.S. Cl. ..... 296/19; 296/21
(58) Field of Search ..... 296/19, 21

(56) References Cited

U.S. PATENT DOCUMENTS

| | | | | |
|---|---|---|---|---|
| 3,667,660 | | 6/1972 | Lewis | 225/1 |
| 3,944,756 | * | 3/1976 | Liniger | 179/111 |
| 4,267,597 | * | 5/1981 | Volpi et al. | 455/76 |
| 4,389,066 | | 6/1983 | Weir et al. | 296/19 |
| 4,484,355 | * | 11/1984 | Henke | 455/76 |
| 4,629,829 | * | 12/1986 | Puhl et al. | 379/58 |
| 4,673,936 | * | 6/1987 | Kotoh | 342/51 |
| 5,509,710 | | 4/1996 | Eavenson, Sr. et al. | 296/19 |
| 5,516,180 | | 5/1996 | Eavenson, Sr. et al. | 296/68.1 |
| 5,573,300 | | 11/1996 | Simmons | 296/197 |
| 5,590,241 | * | 12/1996 | Park et al. | 395/2.36 |
| 5,597,335 | * | 1/1997 | Woodland | 441/36 |
| 5,598,065 | | 1/1997 | Lakosky | 315/77 |
| 5,636,323 | * | 6/1997 | Umemoto et al. | 395/2.35 |
| 5,734,320 | * | 3/1998 | Suzuki | 340/473 |
| 5,749,374 | * | 5/1998 | Schneider, Sr. | 128/870 |
| 5,929,777 | * | 7/1999 | Reynolds | 340/825.49 |
| 5,982,322 | * | 11/1999 | Bickley et al. | 342/357 |
| 5,997,067 | | 12/1999 | Shambeau et al. | 296/57.1 |
| 6,048,018 | | 4/2000 | Shambeau et al. | 296/57.1 |

* cited by examiner

*Primary Examiner*—Joseph D. Pape
*Assistant Examiner*—Greg Blankenship
(74) *Attorney, Agent, or Firm*—Mark D. Wieczorek

(57) ABSTRACT

The invention is directed to an apparatus to attract a missing person in a search and rescue operation. The apparatus includes a vehicle having a body; a plurality of equipment for use in response to a search and rescue emergency disposed within and on the vehicle, the plurality including a siren and a beacon; a power source for powering at least the siren and the beacon; and a circuit coupled to the siren and the beacon for controlling the siren and the beacon.

2 Claims, 3 Drawing Sheets

OFFROAD SEARCH AND RESCUE VEHICLE

CROSS-REFERENCES TO RELATED APPLICATIONS

There are no related applications.

BACKGROUND OF THE INVENTION

A. Field of the Invention

This invention pertains to emergency response vehicles and, more particularly, to vehicles especially equipped with various modules to provide multiple essential emergency services in remote locations.

B. Description of the Related Art

U.S. Pat. No. 5,573,300 to Simmons describes a utility vehicle employing interchangeable emergency response modules. The disclosed vehicle is apparently useful for reaching otherwise inaccessible areas in an industrial plant, and also has interchangeable modular response units which can be removed from the vehicle for separate use or alternatively for installation on a separate utility vehicle.

A vehicle according to the Simmons '300 patent may be very useful in its intended use in an industrial plant. However, the same would be considerably less useful in the field of search and rescue. There is a need for a rescue cart which can be disposed in a mountain or desert location for purposes of attracting a lost or missing person. For example, there is a need for a rescue cart with appropriate signalling capabilities, such as aural and optical, to attract a lost or missing person.

SUMMARY OF THE INVENTION

In one aspect, the invention is directed to an apparatus to attract a missing person in a search and rescue operation. The apparatus includes a vehicle having a body; a plurality of equipment for use in response to a search and rescue emergency disposed within and on the vehicle, the plurality including a siren and a beacon; a power source for powering at least the siren and the beacon; and a circuit coupled to the siren and the beacon for controlling the siren and the beacon.

Implementations of the invention may include one or more of the following: the plurality of equipment may further include a microphone coupled to a signal processor; at least one of the siren, the beacon, or the microphone may be mounted on a rotating turret; and a console may be provided to control the siren and the beacon.

The plurality of equipment may further include equipment for rescue of persons and tactical operations by law enforcement personnel. The equipment for rescue of persons and tactical operations by law enforcement personnel may include: a) means for rescuing persons and tactical operations; b) an emergency warning light; c) an area light; d) a siren; e) a control panel; and g) a storage compartment.

The means for rescuing persons and tactical operations may include: a) a hydraulic rescue tool; b) a confined space rescue tripod; c) an axe; d) a fire extinguisher; e) a generator; f) a portable work light; g) a rope; h) a self-contained breathing apparatus; I) a plurality of poles to prod into snow, ice, etc., for location of buried persons; j) a longhandled hook for water rescues; k) flares; l) signalling mirrors, m) a CB radio; and n) a winch employing a chain or rope which may be used to haul up a lost person or lower a rescuer.

The plurality of equipment may also include equipment for provision of emergency medical treatment, such as: means for treating sick and injured persons; and a storage compartment.

The means for treating sick and injured persons may include: a) a cardiac defibrillator; b) an aneroid sphygmomanometer; c) an intravenous fluid delivery means; d) an oxygen cylinder and bracket therefor; e) a patient cot and fastener therefor; f) a back board; and g) a plurality of medical supplies.

This invention provides several advantages over previous emergency response vehicles. For example, the invention provides a vehicle that can maneuver on difficult terrain. The invention provides a vehicle equipped with numerous devices structured, configured, and designed to attract a missing person in a wilderness, forest, tundra, woods, mountain, valley, desert, or other locale which tends to attract hikers, walkers, hunters, skiers, or other sportspersons.

These and other objects and advantages of the present invention will become more apparent from the description hereinafter.

DESCRIPTION OF THE DRAWING

In the drawing, which illustrates an embodiment of the present invention and is not intended to be limiting.

DESCRIPTION OF THE PREFERRED EMBODIMENTS

Although hereinbelow are described what are at present considered the preferred embodiments of the invention, it will be understood that the invention can be embodied in other specific forms without departing from the spirit or essential characteristics thereof. The present embodiments are, therefore, to be considered in all aspects as illustrative and not restrictive. Accordingly, the invention is limited solely by the claims appended hereto.

Figure 1:
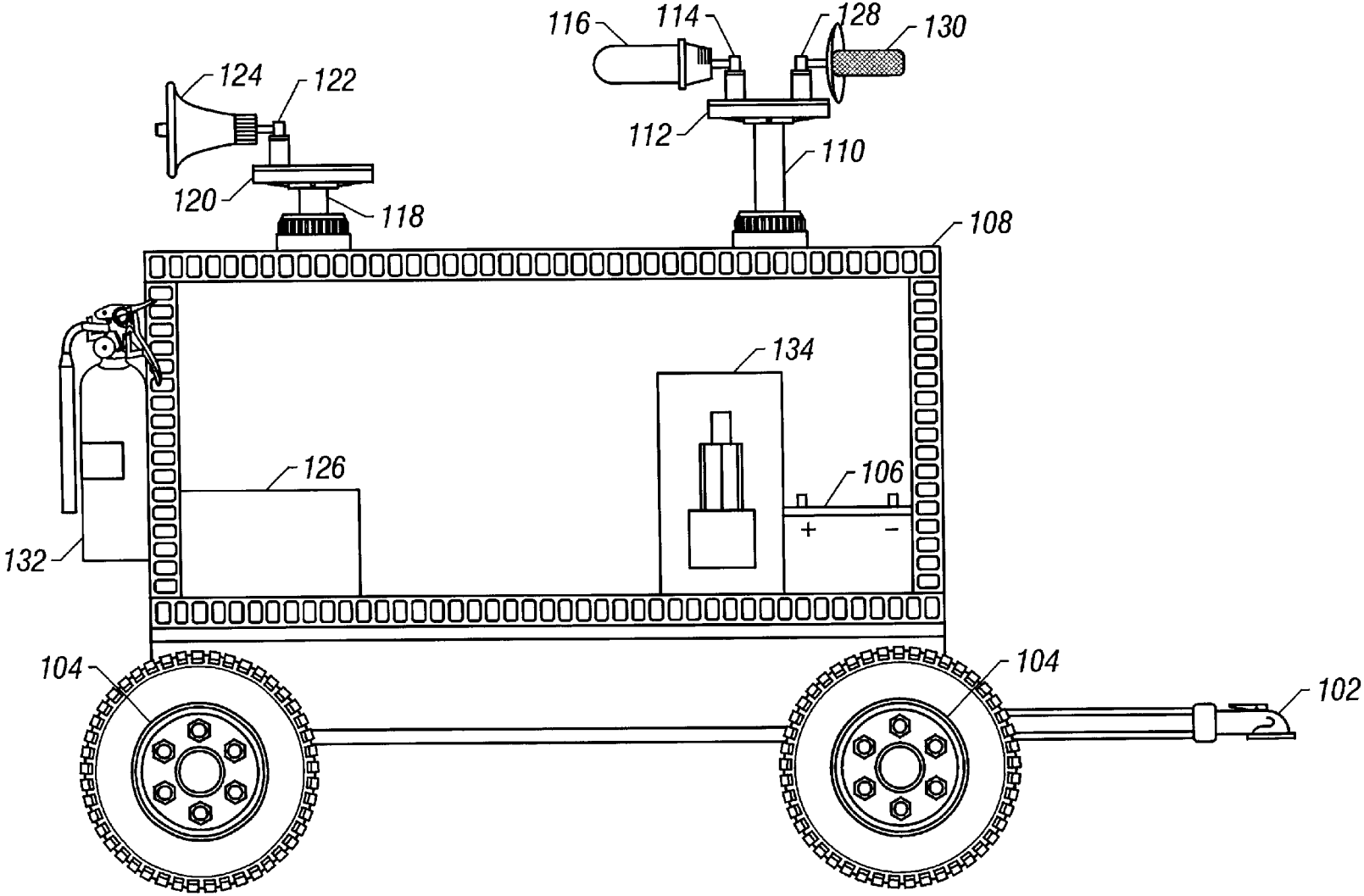
FIG. 1 is a side cross-sectional view of a search and rescue utility vehicle, constructed in accordance with the principles of the invention.

Turning now to the drawing, in which similar reference characters denote similar elements throughout several views, FIG. 1 illustrates one embodiment of a search and rescue vehicle constituting this invention.

The embodiment shown in FIG. 1 consists of a utility vehicle in the form of a trailer 108. In this embodiment, the utility vehicle 108 is shown as a trailer. However, it is an object and an advantage of the present invention that the vehicles disclosed herein are adaptable to many different vehicles, including, but not limited to, four-wheel drive vehicles, snowmobiles, amphibious vehicles, sport utility vehicles, etc. For purposes of this Patent Specification, utility vehicle shall be defined to include snowmobiles, snow-cats, amphibious vehicles, and other vehicles designed for operation on surfaces other than pavement.

The trailer 108 may be towed by a powered vehicle (see also FIGS. 2–3) or may be a powered vehicle itself. In the embodiment of FIG. 1, in which the trailer 108 is towed, a tow bar and attachment socket 102 may conveniently be employed. The trailer 108 may have at least two wheels 104, and preferably four to allow sufficient stability when the trailer 108 is unhitched from the towing vehicle. The use of four wheels may also allow more alternator-supplied power to recharge the batteries of the search and rescue devices employed by the vehicle. In other words, each wheel may power a generator or alternator, an example of which is shown by alternator 134, which may in turn power the sirens and lights to be described below. More particularly, the alternator 134 may supply power to rechargeable battery cells 106 which in turn power the search and rescue devices. The floor of the trailer may have a hollow horizontal section in which to store the battery cells 106. As the battery cells 106 may be quite heavy, the same may be situated in the corners of the trailer to evenly weight the trailer. In the case of the embodied trailer, the weighting should allow a regular-size truck or SUV to pull the vehicle. In the case of the rescue vehicle having its own engine, appropriate weighting may include a consideration of the weight of the engine.

In some circumstances, the trailer may be embodied in a cart that may be disposed in the bed of a full-size pickup truck. In this case, the size may be, for example, 6' by 8'. If desired for manufacturing reasons, the cart may be the same size in all embodiments but may be placed on a trailer in a way similar to that described above to be towed or may alternatively be placed in the bed of a pickup truck.

In the upper section of the trailer, above the batteries, e.g., other supplies may be held, including extra water, medicines, food rations, warming blankets, and extra spotlights. Room may be allowed for carriage of the person once they are located. A board, sliding on rails, could be employed to push the rescued person onto the floor of the top section. Numerous doors, such as door 126, could be provided, on both the bottom and the top layers, to allow entry by rescue personnel to retrieve any of the items mentioned, as well as similar other items.

The trailer 108 may further include a fire extinguisher 132 to be used in case the search and rescue mission occurs in a fire zone.

The plurality of equipment may further include equipment for rescue of persons and tactical operations by law enforcement personnel. The equipment for rescue of persons and tactical operations by law enforcement personnel may include: a) means 159 for rescuing persons and tactical operations; b) an emergency warning light 107; c) an area light 109; d) a siren; e) a control panel 111; and g) a storage compartment 113.

The means for rescuing persons and tactical operations may include: a) a hydraulic rescue tool 115; b) a confined space rescue tripod 117; c) an axe 119; d) a fire extinguisher 132; e) a generator 134; f) a portable work light 121; g) a rope 123; h) a self-contained breathing apparatus 125; I) a plurality of poles 127 to prod into snow, ice, etc., for location of buried persons; j) a longhandled hook 129 for water rescues; k) flares 131; I) signalling mirrors 133, m) a Cl3 radio 135; and n) a winch 137 employing a chain or rope which may be used to haul up a lost person or lower a rescuer.

The plurality of equipment may also include equipment for provision of emergency medical treatment, such as: means 139 for treating sick and injured persons; and a storage compartment 141.

The means for treating sick and injured persons may include: a) a cardiac defibrillator 143; b) an aneroid sphygmomanometer 145; c) an intravenous fluid delivery means 147; d) an oxygen cylinder 149 and bracket 151 therefor; e) a patient cot 152 and fastener 153 therefor; f) a back board 155; and g) a plurality of medical supplies 157.

The particularly important portions of the trailer are shown mounted to its roof. It will be clear to one skilled in the art that the same may be mounted on the side or in various other configurations, such as within a cage in the interior of the trailer, so long as the trailer had open sides.

The trailer may employ devices that assist in search and rescue procedures. In particular, these devices may serve to attract a lost or missing person to the vicinity of the trailer. These devices may include, or in subcombinations thereof, a siren or speaker 124, a search light or rescue beacon 116, and a highly sensitive microphone 130. Each may be mounted rotatably, such as on a rotating turret, to increase the range of effect of the signaling device. The siren and beacon may be controlled by a circuit 101. Controls for the circuit 101, and thus for the siren and beacon, may be by way of a console 105.

For example, the siren 124 may be mounted via mount 122 to mount 120 on rotating turret 118. Similarly, the light or beacon 116 may be mounted via mount 114 to mount 112 on rotating turret 110. And correspondingly, the microphone 130 may be mounted via mount 128 to mount 112 on rotating turret 110. It is advantageous to have the light or beacon 116 mounted at an altitude higher than the remaining devices so that the light is not blocked from reaching potential vicinities where missing persons may be notified of its presence.

The siren 124 may employ both a loud police-car-type siren, known for its far-reaching coverage, and a separate aural indication of the nature of the source, e.g., the siren may announce the presence of a rescue vehicle. In this case, a recorded message, such as from a relative of the victim or lost person, may be employed to further attract the lost person. It is known that some rescued persons, particularly in confused or desperate states, may feel threatened by rescuers. Such persons may be attracted, and comforted, by hearing a familiar voice, or at least by hearing that the rescuers are genuinely rescuers and not, e.g., hunters.

In times when the siren (or "bullhorn") is not operating, the microphone 130 may listen to noises in the missing person's vicinity to determine if the noises are likely to correspond to a lost person. To this end, special filtering and signal processing may be performed on the microphone output to filter out known noises due to wind, brustling trees, leaves, birds, etc. This processing may employ a signal processor 103. The angular dependence of the noise may give a further indication of at least the angle at which the missing person is located, if not also the distance.

Another electrical connection to the vehicle 108 may be a power cord. The same may be used in situations where an electrical outlet is available. Of course, the vehicle may also operate using power from generators.

Figure 2:
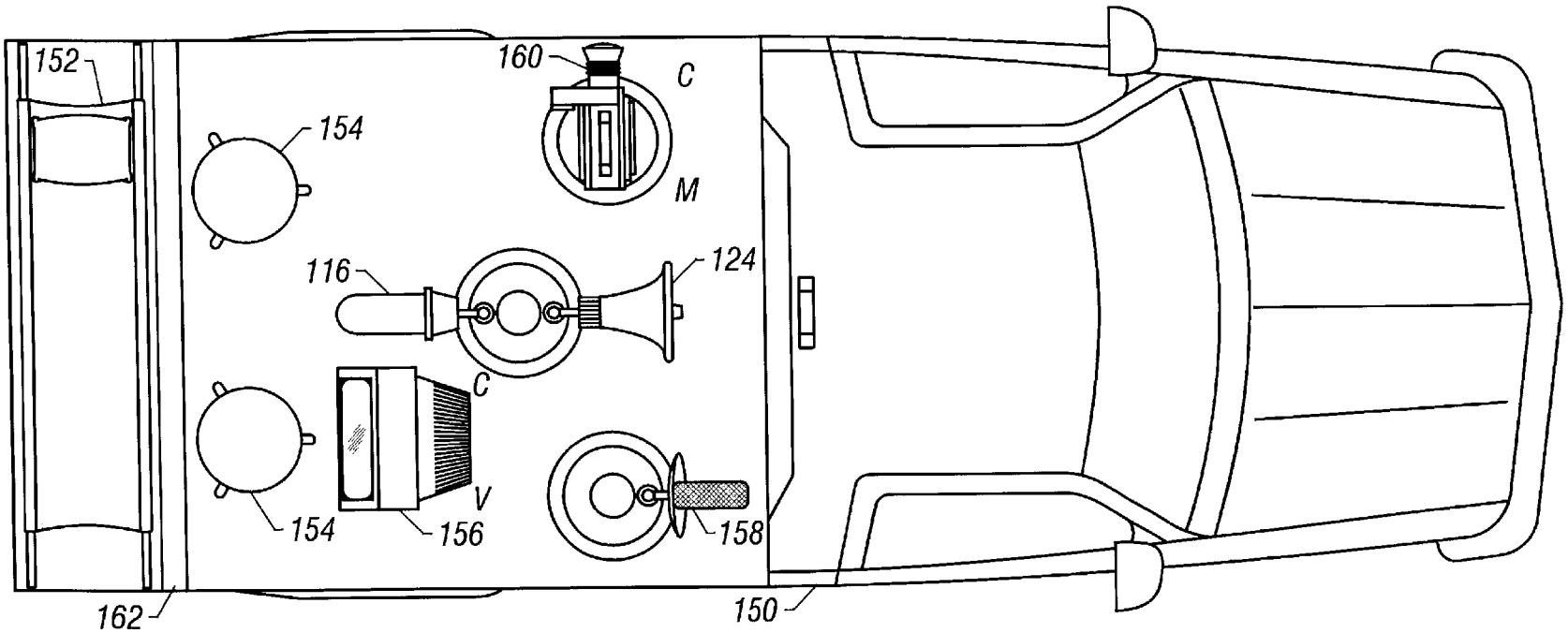
FIG. 2 is a top schematic view of an alternative embodiment of a search and rescue utility vehicle constructed in accordance with the principles of the invention.

FIG. 2 shows an alternate embodiment of the invention which is embodied in the form of a device which may be carried in the bed of a full-size pickup truck 150. In this case, the device may be of dimensions about 6' by 8'. The truck 150 may have a bed that can hold a stretcher 152 in which a person may be situated. The stretcher 152, which may also be in the form of a gurney, may employ rails 162 that mate with corresponding rails on the truck to provide a secure connection and to eliminate movement during vehicle operation. Two chairs or stools 154 may be disposed next to the stretcher for assisting the lost person in the stretcher 152. The chairs 154 may employ seat belts (not shown) for safety. It is envisioned that with a full-size truck bed, the stretcher will account for space such that at least a 5' by 6' area is left available for the siren, lights, storage boxes, etc.

A video monitor 156 may be disposed adjacent one of the chairs 154 to enable a rescuer to monitor the various instruments on the device. For example, a siren or horn or speaker 124 may be located at a high location on the truck bed as described in connection with FIG. 1 above. In the same way, a high-intensity light, such as a halogen lamp 116, may also be so located. Instruments such as a listening device 158 and an optical detector 160 may be located at the extremities of the truck bed in order to listen and watch for lost persons employing an acuity that unassisted human senses are not capable of. For example, the listening device 158 may be especially tuned to human voice frequencies and may have high-power amplifiers connected thereto. Optical detector 160 may have high-power optics such as telescopic lenses employing color filters to render the rescuers more likely to be able to sense a lost person given the environment; e.g., a filter may absorb green light for a search performed in a forest.

Figure 3:
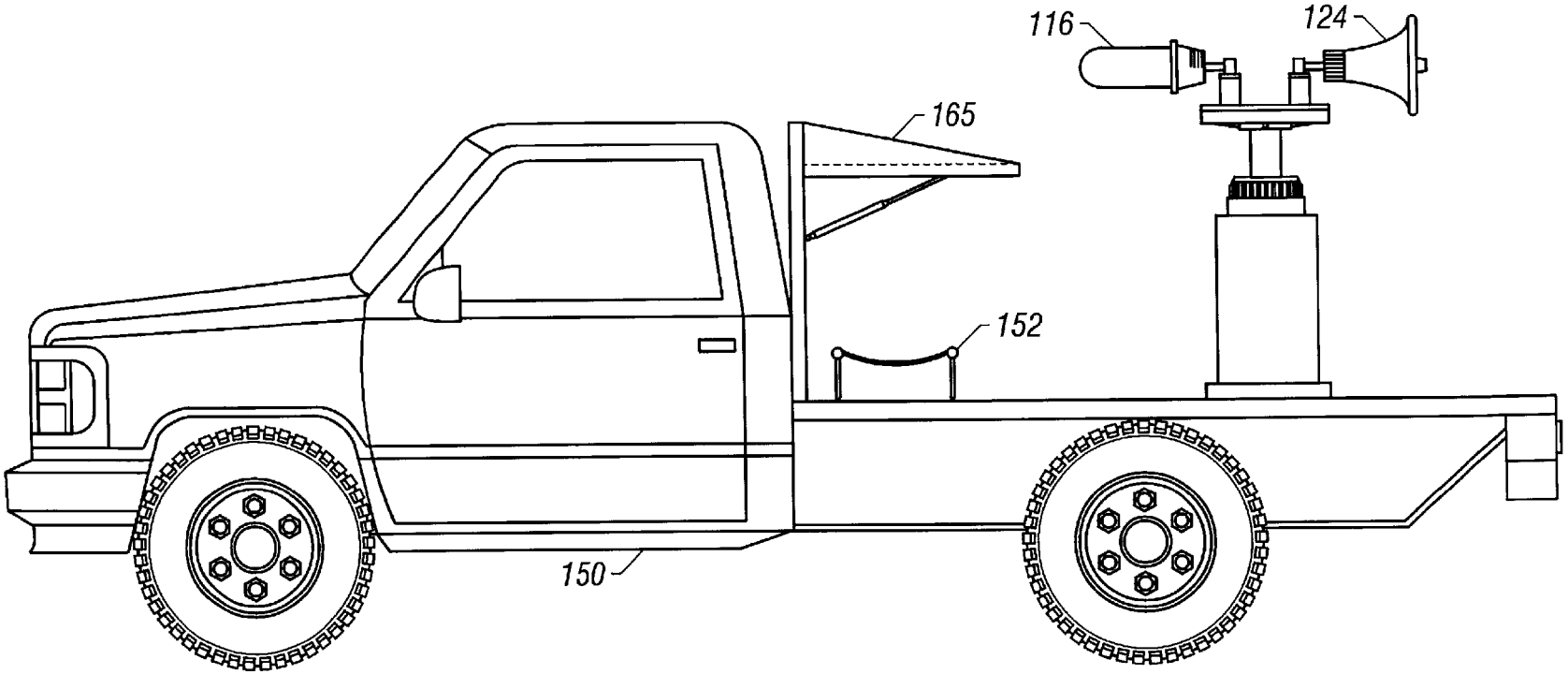
FIG. 3 is a side schematic view of another alternative embodiment of a search and rescue utility vehicle constructed in accordance with the principles of the invention.

FIG. 3 shows a third embodiment of the invention. This embodiment is similar to the embodiment of FIG. 2 in several respects. However, FIG. 3 also shows a retractable cover 165 over the patient gurney or stretcher 152. The retractable cover 165 may be employed to cover the patient on his or her trip to a city or hospital as needed. The retractable cover 165 may be especially employed in harsh environments, such as rain, and snow.

The vehicle may also include a base station for reception of signals from locating devices such as from EPIRBs or walkie-talkies having embedded therein a locating devices 161. It is envisioned that hikers, for example, may purchase or rent such locating devices. These devices may be specific to the forest or vicinity in which the hiker may be hiking. If the hiker is lost, the hiker may activate the signal sending portion of the locating device to cause a signal to be sent out. The locating device may have, for example, a working radius for sending signals of several tens of miles. The base station may be preset to the frequency of transmission (if the same is known) or may alternatively scan numerous frequencies (if the frequency of transmission is unknown). It should also be noted that the same could be activated upon contact with water, darkness, or other such environmental condition so as to alert a rescue team in the case where the hiker is disabled or unconscious.

The manner of usage and operation of the invention described above being readily apparent from the above disclosure, no further discussion relative to the manner of usage and operation of the invention shall be provided.

With respect to the above description, it is to be understood that the optimum dimensional relationships for the parts of the invention, as well as variations in size, materials, shape, form, function, and manner of operation, assembly, and use, and equivalents of all the foregoing, are apparent to one skilled in the art. Such equivalents are intended to be encompassed by the present invention.

Therefore, the foregoing is considered as illustrative only of the principles of the invention. Further, since numerous modifications and changes will be readily apparent to those skilled in the art, it is not intended to limit the invention to the exact construction and operation shown and described, but to encompass all suitable modifications and equivalents within the scope of the invention.

The scope of the invention is indicated by the appended claims rather than by the foregoing description.

What is claimed is:

1. A trailerable modular apparatus to attract a missing person in a search and rescue, comprising:

a) a trailerable vehicle having a body;

b) a plurality of equipment for use in response to a search and rescue emergency disposed within and on said trailerable vehicle, said plurality of equipment including a siren and a beacon;

c) a generator power source for powering at least said siren and said beacon; and d) a circuit coupled to said siren and said beacon for controlling said siren and said beacon.

2. The trailerable modular apparatus of claim 1, wherein said apparatus is structured and configured to be disposed in a bed of a pick-up truck.

* * * * *